US005896581A

United States Patent [19]

Wong

[11] Patent Number: 5,896,581

[45] Date of Patent: Apr. 27, 1999

[54] UNITARY CLOTHING WITH AN IMPROVED DROP-SEAT

[76] Inventor: Lavinia C. Wong, P.O. Box 268, Schnecksville, Pa. 18078

[21] Appl. No.: 08/699,797

[22] Filed: Aug. 19, 1996

[51] Int. Cl.[6] ..... A41B 9/00

[52] U.S. Cl. ..... 2/78.2; 2/79; 2/227

[58] Field of Search ..... 2/78.2, 78.1, 80, 2/114, 408, 227, 228, 238

[56] References Cited

U.S. PATENT DOCUMENTS

| | | | |
|---|---|---|---|
| 1,587,099 | 6/1926 | Williams | 2/78.2 |
| 1,785,581 | 12/1930 | Fellroth | 2/79 |
| 2,849,717 | 9/1958 | Klotz | 2/79 |
| 4,457,025 | 7/1984 | Meryash | 2/79 |
| 4,607,396 | 8/1986 | Craig | 2/79 |
| 5,014,356 | 5/1991 | Tomasi-Dubois | 2/79 |

*Primary Examiner*—Gloria Hale
*Attorney, Agent, or Firm*—Thomas A. Beck

[57] ABSTRACT

A unitary garment with a modified and improved drop-seat which is not overtly detectable by the casual observer. The rear portion of the garment is constructed with two plies of fabric. The inner ply contains a teardrop-shaped aperture (12) bounded by elastic around the perimeter. The outer ply incorporates a trapezoidal-shaped lappet (20) with elasticized sides. The combination of these two innovations enables a heretofore unachievable style line which closely conforms to body contours. Due to the elastic tension around the perimeter the aperture is relatively static in relation to the buttocks and upper thigh thereby allowing the wearer freedom of movement during toilet and personal hygiene activities without fear of inadvertently wetting or soiling the garment. Multiple styling embodiments are possible (e.g., jumpsuit, culottes, shorts, formal-, casual-, sports-wear, et al).

16 Claims, 2 Drawing Sheets

UNITARY CLOTHING WITH AN IMPROVED DROP-SEAT

BACKGROUND—FIELD OF INVENTION

This invention relates to unitary (one-piece) clothing—consisting of an integrated "top", or bodice, and a "bottom" (e.g., pants, culottes, shorts)—modified with an improved drop-seat design which facilitates toilet and personal hygiene activities.

BACKGROUND—DESCRIPTION OF PRIOR ART

A review of applicable prior art described in patents issued over the period 1914 to date, most notably during the 1976 to 1992 time frame, reveals significant shortcomings in the fit, style, and ease of use of the various drop-seat designs during toilet and personal hygiene activities. Sampey, U.S. Pat. Nos. 3,949,427 (Apr. 13, 1976) and 3,994,026 (Nov. 30, 1976); Spaulding, U.S. Pat. No. 3,956,774 (May 18, 1976); Marcellaro, U.S. Pat. No. 5,447,911 (May 15, 1984); Tomasi-Dubois, U.S. Pat. No. 5,014,356 (May 14, 1991); and Fiveash, U.S. Pat. No. 5,163,189 (Nov. 17, 1992) have all addressed drop-seat applications adapted to jumpsuits. The drop-seat application in these prior designs all suffered from limitations:

whereby the drop-seat panel, or lappet, did not closely conform to contours of the body, the lappet was easily discernible, drawing undesirable attention to the basic toilet function of elimination, the methods for securing the lappet tended to be cumbersome when partially disrobing in toilet facilities, the risk of inadvertently wetting or soiling the garment remained an ever-present possibility.

OBJECTS AND ADVANTAGES

Accordingly, the instant invention overcomes the identified limitations by:

providing a means to enhance the styling line of a unitary outer garment by conforming to the body contours of the buttocks and hip area.

enabling a pattern cut and a variety of secure closure device options which render the drop seat lappet virtually undetectable by the casual observer.

sustaining the basic purpose of the drop seat function to enable seated toilet functions without the necessity of laborious partial disrobing from the unitary outer garment (with the attendant possibility of accidental wetting or soiling of the clothing).

DRAWING FIGURES

Figure 1:
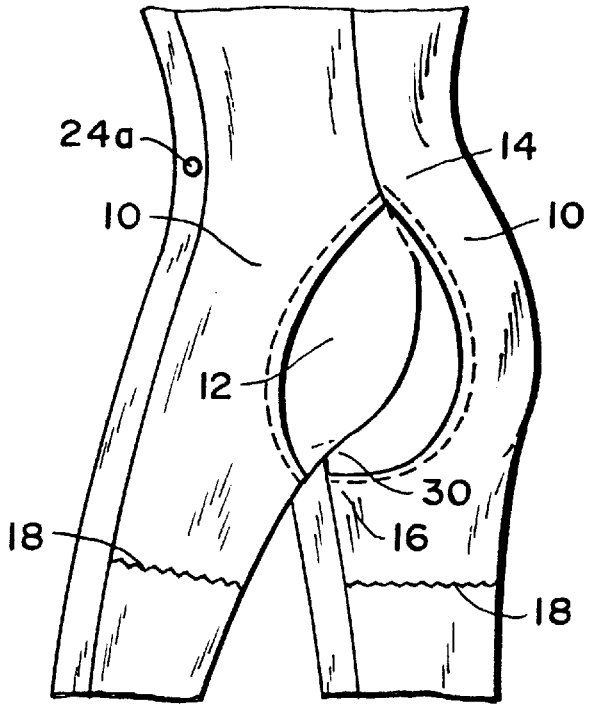

FIG. 1—Static rear quartering view, inner ply

Figure 2:
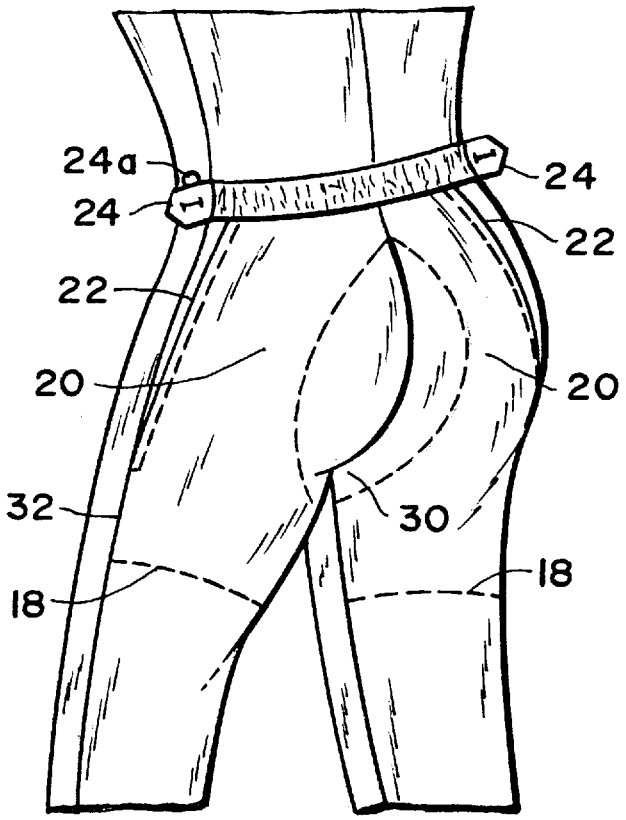

FIG. 2—Static rear quartering view, outer ply

Figure 3:
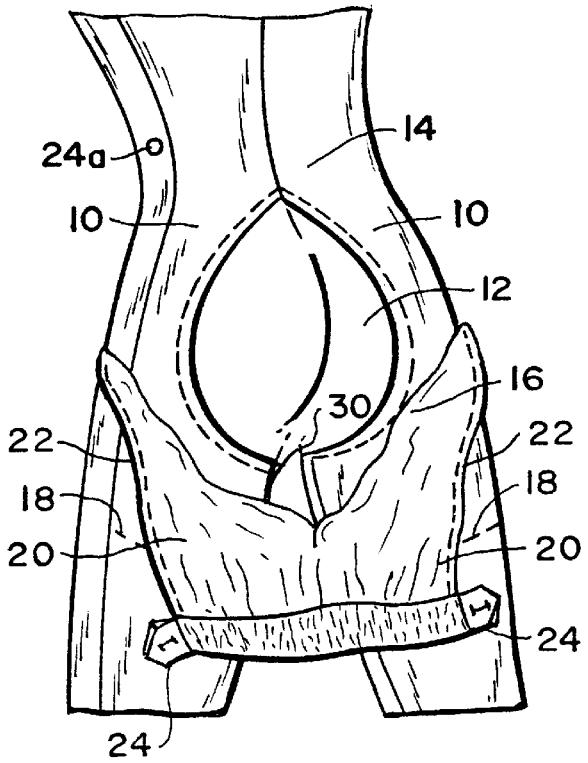

FIG. 3—Rear quartering view, lappet partially lowered

Figure 4:
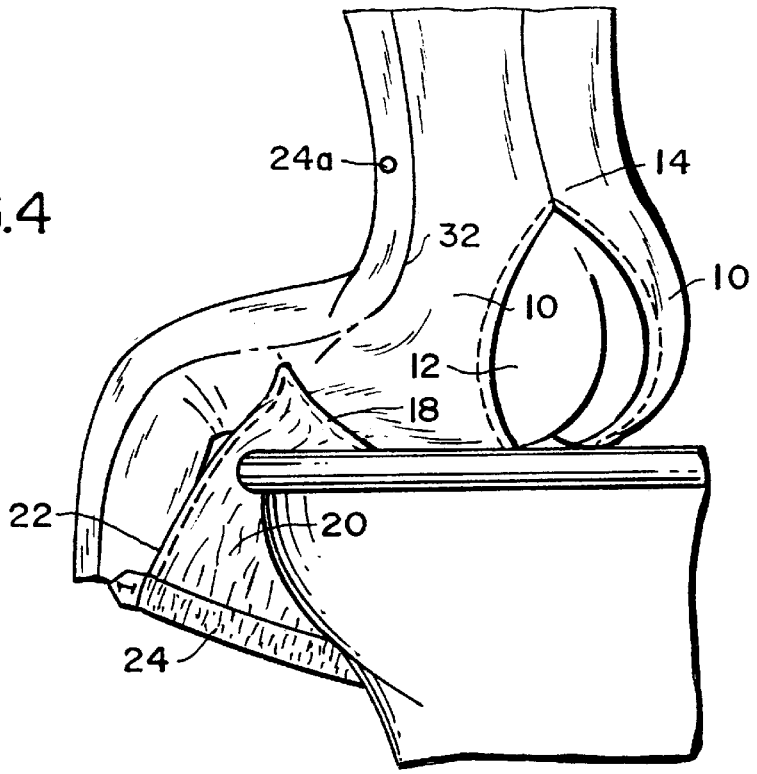

FIG. 4—Front quartering view, partially disrobed and seated

REFERENCE NUMERALS IN DRAWINGS

10 Posterior inner ply quarter panels, left and right
12 Posterior inner ply, teardrop-shaped aperture
14 Posterior inner ply upper terminus, aperture
16 Posterior inner ply lower terminus, aperture
20 Posterior outer ply drop-seat lappet panels, left and right
22 Angled and elasticized lateral lappet perimeter, left and right

24 Lappet waist-line belting w/fastener(s)
30 Inseams, upper thigh, left and right
32 Sideseams, lower torso & upper thigh, left and right

DESCRIPTION, FIGS. 1 & 2

The drop-seat modification for unitary garments incorporates a curvilinear rear access aperture (12) which is covered during normal wear by the partially removable quadrilateral drop-seat lappet (20) covering the posterior of the wearer. The instant design consists of two plies of fabric used for constructing of the lower rear portion of the garment. Joining of the front and rear panels of the lower portion of the unitary garment is accomplished in standard commercial fashion with a U-shaped "rise" forming the crotch of the garment. Uniquely cut and sewn fabrication of both the posterior aperture (FIG. 1) in the lower torso portion of the garment and its corresponding drop-seat lappet cover (FIG. 2) serves to reduce the marketplace objection to prior art embodiments of the drop-seat application. The drop-seat modification provides a suitable opening to facilitate toilet and personal hygiene while providing substantial concealment of the functional purpose of the modification.

The drop-seat modification to a unitary garment is fabricated as follows:

FIG. 1 illustrates the posterior panel, inner ply (10), which has the teardrop-shaped aperture (12) centered, left-to-right, over the wearer's buttocks. The aperture is fabricated in the posterior area of the lower torso section of the garment, the vertical limits of which extend from slightly below the waistline (14) to somewhat below the crotch (16). The smaller end of the aperture is at the apex. The specific configuration, which is somewhat dependent on the size, cut, and style of the embodiment of the garment, contributes to the ability to provide substantial conformance to the shape of the wearer's body contour. The aperture contains an embedded elastic cord or tape sewn into the perimeter. The elastic tension thus provided both maintains the geometry of the aperture and stabilizes the aperture's attitude in relation to the wearer's buttocks and crotch area. The lower terminus point of the aperture is anchored left and right, joining at the inseam (30) somewhat below the point where the extended inseam/crotch-seam mates the front and rear portions of the garment. The positioning of the lower terminus at the inseam somewhat below the crotch contributes to non-binding comfort for the wearer. It allows a seating posture on a commode which provides unrestricted access during toilet elimination functions. Body movements tend to have little effect on the positioning of the aperture, even during strenuous sporting activities.

FIG. 2 illustrates the posterior outer panel which incorporates the lappet (20) which completely covers the aperture contained in the inner panel. The natural bias and elasticity of the cloth is augmented by an embedded elastic tape or cording along the left and right hand near-vertical sides of the lappet (22) to assist in establishing a body-conforming fit on the posterior of the wearer. The lower terminal points of the sides of the lappet are stitched into the sideseams (32) approximately aligned horizontally with the crotch-inseam-aperture terminus. The positioning of the sideseam anchor point (24) limits the range of the lowered lappet minimizing the possibility of wetting or soiling the garment during toilet use. The lappet is secured in its uppermost position for normal wear by any of a variety of conventional fastening means (e.g., belt, half-belt, tabs, drawstring, sash, buttons, snaps, hook and loop, hook and eye, buckle, et al). The waistline (top) edge of the lappet can be elasticized to assist in conforming to the body contours of the wearer.

The inner construction does not limit garment design applications. A unitary garment incorporating the dropseat modification can be worn as an article of clothing over the upper and lower torso of a man, woman, or child. It has application for all types of dress, including formal, casual, work, and recreational environments. The construction of the posterior panels is illustrated and described in a preferred embodiment, representing a standard fabrication process in the garment industry. Other manifestations are potentially feasible. The posterior inner and/or outer panel(s) may be cut from a single piece of fabric, rather than the illustrated left and right quarter panels joined at the center. Alternatively, multiple smaller panels could be joined to constitute the whole. The key features are to provide the properly sized and tensioned aperture and the lappet to conceal the aperture, all the while maintaining a pleasing style line which conforms to body contours and allows easy and trouble-free access to toilet facilities.

OPERATION, FIGS. 3 & 4

The garment is donned in a conventional manner, consistent with the type fastenings and closures provided in the design. When the need for bodily elimination arises the wearer releases the appropriate fastener(s), which secure the drop-seat lappet at or near the waistline in normal wear, and lowers the lappet (FIG. 3), pulling the lappet forward between the thighs sufficiently to expose the buttocks and crotch area in preparation for assuming the seated position upon the toilet commode (FIG. 4). The attachment points of the lappet limit the range it can be lowered and serve to preclude the lowered and extended lappet panel from becoming soiled by immersion in the toilet or coming into contact with the surrounding floor area. After accomplishing the necessary toilet and personal hygiene activities the wearer arises and resecures the lappet over the aperture.

SUMMARY OF ADVANTAGES, RAMIFICATIONS, SCOPE

The improved drop-seat previously described manifestly provides an improved functional and stylish approach for the manufacture of unitary garments.

The improved drop-seat enables basic toilet functions to be accomplished without the need for an inordinate amount of disrobing by the wearer of a unitary garment.

The improved drop-seat virtually eliminates the possibility of inadvertent wetting or soiling of the garment in the performance of toilet and personal hygiene functions.

The fit of the drop-seat area of a garment can be made to closely conform to the body contours of the wearer.

Application of described design and manufacturing techniques serve to mask the functional purpose of the drop-seat modification for unitary garments.

Unitary clothing styling variations are almost limitless, to include formal wear, casual wear, and sports wear.

The preceding description contains certain specifications which should not be construed as limiting the scope of the invention. A wide variety of embodiments suitable for unitary clothing styles, gender, and ages of intended wearers is possible. Many variations in the manufacturing process can be implemented to incorporate the innovative features of the uniquely improved drop-seat modification for unitary garments.

The scope of the invention should be determined by the appended claims and their legal equivalents, rather than by the examples given.

I claim:

A modified dropseat application for unitary garments comprising:

1. A unitary garment comprising a bodice portion having two arm openings and a neck opening, and means to enable the wearer to don said unitary garment, said bodice integrally connected at an elastic waistline to a pants portion, said pants portion comprising a pair of leg openings and a dropseat lappet, said unitary garment having an anterior section, a posterior section, a left side and a right side, each said side having an outside seam, said pants having a left inseam and a right inseam and a crotch seam therebetween, a generally curvilinear opening in said posterior section extending arcuately from said left inseam to a seam centrally located on said posterior section, said seam extending substantially vertically from and beneath said waistline, said opening continuing arcuately from said seam to said right inseam, a horizontal seam between said right side inseam and said left side inseam comprising said crotch seam, the posterior section of said garment adjacent to and defining said opening having a periphery incorporating elastic means therein, a panel extending vertically downward within each said leg of said pants a portion of the length of each said leg of said pants, a top edge of said panel formed from and integral with said posterior section adjacent said periphery and having a second edge, a third edge and a transverse edge, each said panel secured along its second edge to said outside seam, and along its edge to the corresponding inseam diametrically opposite said outside seam, said transverse edge of each panel being unattached, the posterior section below said waistline in extending to the transverse edge of each said panel and from said right outside seam to said left outside seam and forming an inner ply, said dropseat lappet having an upper and lower section, said lappet located on the posterior section of said unitary garment adapted to cover said curvilinear opening and integrally formed as a part of the posterior section of said pants and secured at its lower section to said crotch seam and said left and right inseams, said dropseat lappet having a substantially trapezoidal form configuration comprising left and right lateral sides each having edges with elasticized means therein, each said lateral side extending from a respective side seam to a horizontal elasticized transverse waist band along said upper section, said waist band having means for securing the waist band to maintain said dropseat lappet in a closed position; said dropseat lappet shiftable between a closed position wherein the waist band is secured in said anterior section of said garment so said dropseat lappet covers said opening and said inner ply; and an open position wherein said dropseat lappet is detached from said anterior section of said garment thereby exposing said opening and said inner ply.

2. The unitary garment defined in claim 1 wherein said waistband has strips extending therefrom forming belt elements extending from each side suitable for being secured on said anterior section of said unitary garment.

3. The unitary garment defined in claim 1 wherein said waistband has a drawstring extending from each side suitable for being secured on said anterior section of said unitary garment.

4. The unitary garment defined in claim 1 wherein said waistband has a sash extending from each side suitable for being secured on said anterior section of said unitary garment.

5. The unitary garment defined in claim 1 wherein said waistband has tab means extending from each side capable of being secured to fastening means located on said anterior section of said unitary garment.

6. The unitary garment defined in claim 5 wherein said fastening means positioned on said anterior section of said unitary garment are buttons and said tabs contain button holes to receive and hold in place said buttons.

7. The unitary garment defined in claim 6 wherein said fastening means positioned on said anterior section of said unitary garment are eyes and said tabs contain hooks.

8. The unitary garment defined in claim 6 wherein said fastening means positioned on said anterior section of said unitary garment are loops and said tabs contain hooks.

9. The unitary garment defined in claim 6 wherein said fastening means positioned on said anterior section of said unitary garment are buckles and said tabs contain eyelets to secure said belt in position.

10. The unitary garment defined in claim 6 wherein said fastening means positioned on said anterior section of said unitary garment are grommets and said tabs contain snaps that fasten into said grommets to secure said tabs in position.

11. The unitary garment defined in claim 1 wherein said bodice and pants are embodied in culottes.

12. The unitary garment defined claim 1 wherein said bodice and pants are embodied in a jump suit.

13. The unitary garment defined in claim 1 wherein said pants are embodied in apparel wherein the pants cover only a portion of the legs of the wearer.

14. The unitary garment defined in claim 1 wherein said bodice and pants are embodied in formal wear.

15. The unitary garment defined in claim 1 wherein said bodice and pants are embodied in casual wear.

16. The unitary garment defined in claim 1 wherein said bodice and pants are embodied in sportswear.

* * * * *